US007373682B2

(12) United States Patent
Cetera

(10) Patent No.: US 7,373,682 B2
(45) Date of Patent: May 20, 2008

(54) TAPELER

(75) Inventor: Carl Cetera, Tenafly, NJ (US)

(73) Assignee: Cotapaxi Custom Design and Manufacturing, LLC, Carlstadt, NJ (US)

( * ) Notice: Subject to any disclaimer, the term of this patent is extended or adjusted under 35 U.S.C. 154(b) by 0 days.

(21) Appl. No.: 11/096,961

(22) Filed: Mar. 31, 2005

(65) Prior Publication Data

US 2006/0218826 A1 Oct. 5, 2006

(51) Int. Cl.
*B25C 5/02* (2006.01)

(52) U.S. Cl. ..... 7/160; 7/158; 7/170; 227/76; 227/120; 227/156; 40/358; 40/913

(58) Field of Classification Search ..... 40/358, 40/661, 913; 7/160, 170, 158, 156; 227/127, 227/106

See application file for complete search history.

(56) References Cited

U.S. PATENT DOCUMENTS 3,596,820 A * 8/1971 Lou ..... 227/106
4,727,610 A * 3/1988 Lin ..... 7/160
5,397,045 A 3/1995 Lucas
D411,423 S * 6/1999 Huang ..... D8/50
6,134,994 A 10/2000 Gomas
6,152,347 A * 11/2000 Wilson et al. ..... 227/134
6,233,789 B1 5/2001 Douglas
6,234,050 B1 5/2001 Konen et al.
6,263,599 B1 * 7/2001 Matthews et al. ..... 40/358
6,494,356 B1 12/2002 Frank et al.
6,789,719 B2 * 9/2004 Shor ..... 227/132
6,823,592 B1 11/2004 Rowe
2003/0155398 A1 8/2003 Jairam et al.
2004/0034937 A1 * 2/2004 Ackeret ..... 7/160
2004/0164120 A1 8/2004 Boswinkel et al.
2004/0232192 A1 11/2004 Marks
2006/0026769 A1 * 2/2006 Shevin-Sandy ..... 7/160

* cited by examiner

*Primary Examiner*—Robert J. Sandy
*Assistant Examiner*—Marcus Menezes
(74) *Attorney, Agent, or Firm*—The Soni Law Firm

(57) ABSTRACT

A combination device incorporating stapling and tape dispensing functions. The combination device has a conventional stapler comprising stapling and staple-forming legs, and a roll-shaped tape dispenser disposed within a cavity defined on an upper surface of the stapling leg. The cavity is permanently exposed to an exterior of the device for retaining a roll-shaped tape of various size, and for quick access thereto. It further has an ergonomically contoured hand grip on each leg and advertising material imprinted disposed on at least one its outer surface.

26 Claims, 3 Drawing Sheets

TAPELER

FIELD OF THE INVENTION

The present is directed to a hand held implement which may also be carried as an attachment to one's belt, harness or work area. The invention is ideally directed to commercial uses in an office or warehouse environment, as it includes multiple fastening means typically utilized in those environs. As described and claimed below, this invention is directed to an ergonomically designed fastening device to facilitate comfortable and easy multi-purpose uses and which may be clipped to another article. The invention is directed to the use of staples, small brad nails or similar fasteners, however, the invention also includes an integral tape dispenser.

BACKGROUND OF THE INVENTION

In the past, traditional fastening implements were generally directed to performance of a single task, such as a stapler or a tape dispenser. In addition, these implements generally were either small light duty desk implements or large and bulky industrial devices. Moreover, these fastening devices typically had no means by which they may be easily carried by the user and maintained at the ready in any environment to perform a multitude of fastening tasks, for example in a warehouse operation. Lastly, the repetitive use of a hand held implement such as a stapler often led to fatigue of the user's hand, and, in extreme cases, to medical and neurological issues such as carpal tunnel syndrome.

As used throughout this application, "Tapeler" is a Registered Trademark of the Assignee, Cotapaxi Custom Design and Manufacturing, LLC.

Prior attempts have been made to design multi-functional fastening devices to incorporate the stapling and tape dispensing function. For example, U.S. Patent No. 4,727,610 issued to Lin discloses and claims a stapler with an integral tape dispenser. That device, however, does not satisfy the need for a multifunction device in a commercial or industrial environment. The device is a light duty design with no means to provide any ergonomic comfort, ill suited to the repetitive and frequent use as such use would quickly lead to hand and nerve fatigue and associated problems.

Others have utilized a curved shape in a stapling device, such as U.S. Pat. No. 6,152,347, to Wilson, et al. Once again, however, these devices have no incorporated stapling and tape dispensing function, nor do they contemplate a conveyance and attachment mechanism to provide quick and efficient use in any situation.

In conjunction with the less than efficient use, the previously designed devices are typically designed to rest either upright or on only one outer surface, and will not be balanced and stable when rested in any number of positions, such as on one of their leg portions or on an end. This leads to dropping the device, having it fall off the work surface and generally having to fumble with the device rather than being able to quickly rest the device on a surface and grab it when necessary without concern to its resting orientation.

Finally, with the tremendous utility of a device as contemplated in the present invention, it is essential that it have surface imprinting areas for advertising or graphics. The contemplated invention would be most desirable and would be a valuable promotional item for those businesses which provide services or products to commercial or industrial operations.

What is needed is a versatile and attachable multi-function fastening device which is designed with the industrial or commercial user in mind. Such a device must be efficient and easy to comfortably use for multiple fastening tasks and must be designed to be always within reach of the user.

SUMMARY OF THE INVENTION

The present invention is directed to provide the user in a commercial or industrial setting with a multi-function fastening device. Another object of the invention is to provide the fastening device which will be readily available at all times and provide ergonomic comfort for continuous and frequent use. A further object of the invention is to provide a device which is highly desirable and will become a valuable promotional item, and accordingly, must have smooth and flat surfaces on which a business or professional's advertizing or desired graphics may be imprinted.

The present invention accomplishes these and other objectives by providing a multi-functional fastening implement which has ergonomically contoured and cushioned grips, numerous positions in which it may rest on a surface and many flat smooth surfaces on which material may be imprinted. The Tapeler, as it will be known, is envisioned to have many differing embodiments, based on the needs of the intended user. It will primarily dispense a fastening means of staples or small brad nails, with concurrent capability to dispense any type of tape product which is available in roll form. These products could include adhesive tape, carpet tape, fiber tape or any other similar functioning roll product.

The Tapeler, however, is far more than a simple fastening device. It is designed and configured to be easily grasped, and to be carried by the user so as to be constantly ready to use. To accomplish these objectives, the Tapeler first incorporates ergonomic contoured and cushioned grip leg portions. The use of these contoured cushioned surfaces facilitates tireless use of the device with less likelihood of developing hand fatigue and neurological symptoms commonly associated with continuous repetitive hand tasks.

Moreover, the Tapeler may incorporate an integral mounting for a belt clip or other common attaching device. As such, the Tapeler is truly designed for an industrial or commercial setting, as it may be easily transported yet remain constantly at the ready for any fastening task which one may encounter.

BRIEF DESCRIPTION OF THE DRAWINGS

These and other aspects of the invention will now be described with reference to the accompanying drawings, in which.

DETAILED DESCRIPTION OF THE INVENTION

Figure 1:
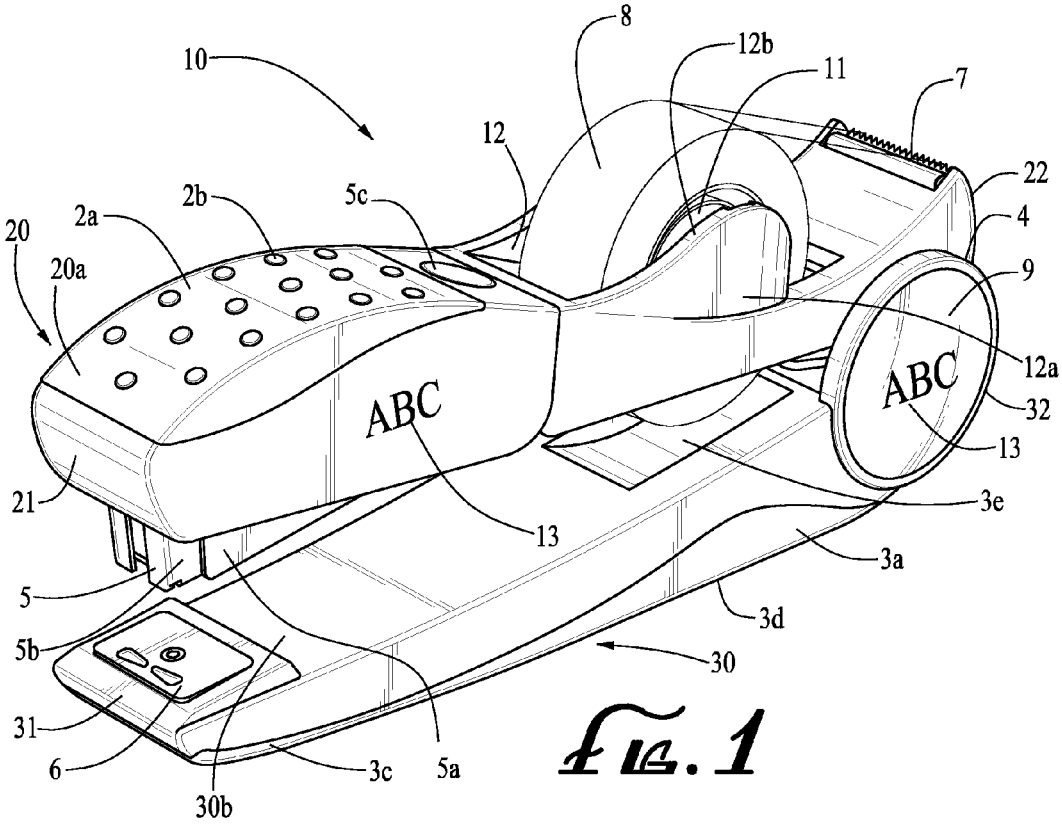
FIG. 1 is a perspective view of a preferred embodiment of the Tapeler assembly, which depicts the contoured ergonomic grip of the stapling leg as well as the stapling and tape dispensing portions of the invention.
Figure 2:
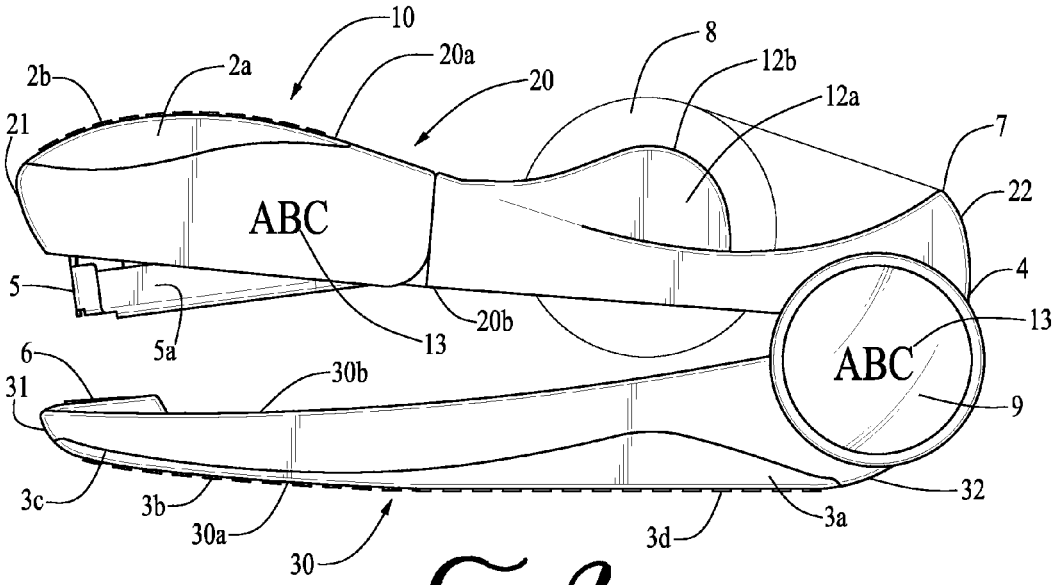
FIG. 2 is a side view of a preferred embodiment of the Tapeler assembly, which depicts the tape dispensing and stapling functions at opposite ends of the device, the two ergonomic gripping legs and a raised circular surface upon which graphical or advertising materials may be imprinted.
Figure 3:
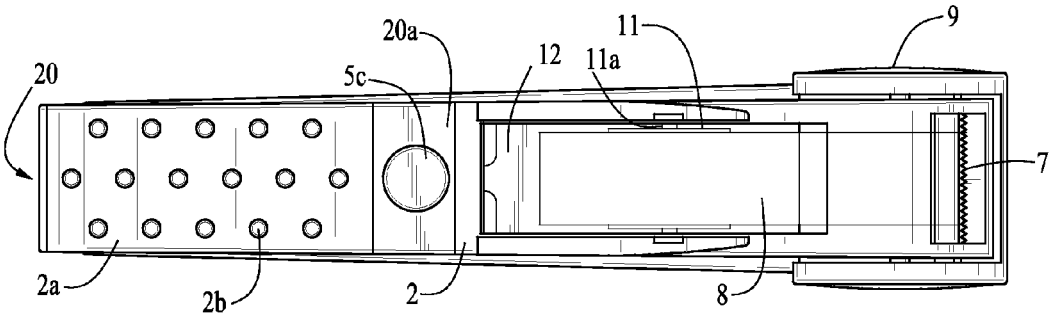
FIG. 3 is a top view of a preferred embodiment of the Tapeler assembly, which again depicts the tape dispenser and the ergonomic grip of one leg of the invention.

The Tapeler, to be referred to as a combination device herein after, incorporates a staple fastening portion and a tape dispensing portion within an ergonomic assembly for ease of use. As shown in FIG. 1, the combination device 10 is comprised of a stapling leg 20, which is attached to a staple forming leg 30 through a pivoting connection 4. Each of the legs 20 and 30 has a front end 21 and 31, respectively, and an opposing rear end 22 and 32, respectively, and an outer surface 20*a* and 30*a*, respectively, and an opposing inner surface 20*b* and 30*b*, respectively, where the inner surfaces 20*b* and 30*b* of the pivotally connected legs face each other. The stapling and staple forming legs are pivotally connected at their respective rear ends 22 and 32. Referring to FIGS. 1, 2, and 3, a preferred embodiment of the combination device 10, a conventional stapling head 5 which is connected with a staple storage housing 5*a*, and a staple storage 5*b* are mounted preferably under the stapling leg 20, and an eject button 5*c* for ejecting the staple storage 5*b* and stapling head 5 is formed preferably on the outer surface 20*a* of the stapling leg 20. On the outer surface 20*a* of the stapling leg 20, a cushioned grip 2*a* provides a comfortable and efficient contoured gripping surface, which optionally may further include non-slip surface projections 2*b*, or indentations for providing traction.

Figure 6:
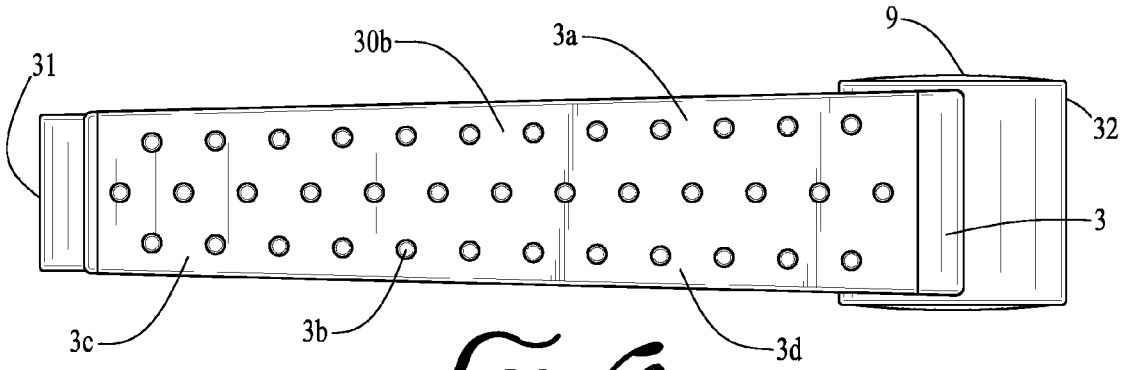
FIG. 6 is a bottom view of a preferred embodiment of the Tapeler assembly, which depicts the contoured grip of the staple forming leg, as it incorporates both a contoured portion for gripping and a flat portion which provides a stable and non-slip surface upon which the Tapeler may rest.

As shown in FIGS. 1, 2 and 3, the stapling head 5 in the preferred embodiment mates with a forming plate 6, which is formed on the inner surface 30*b* of the staple forming leg 30. This forming leg 30 also includes a similar cushioned grip surface 3*a* superimposed on the outer surface 30*a* thereof, which is curved and contoured toward the gripping end 3*c*, and proceeds to a flat portion 3*d* that extends along the bottom length of the combination device 10. On the inner surface 30*b* of the forming leg 30, a recessed section 3*e* permits the user to utilize the stapling function of the combination device while a fully sized tape roll 8 remains loaded on the invention. Referring to FIGS. 2 and 6, the flat portion 3*d* is utilized to provide a non-slip surface on which the device may be rested on a surface. The forming leg surface 3*a* may similarly include non-slip projections 3*b*.

Figure 4:
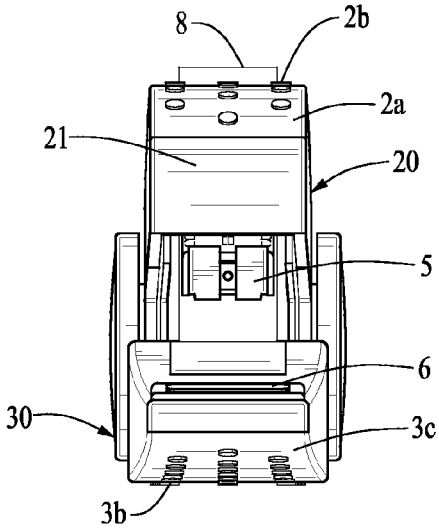
FIG. 4 is an end view of a preferred embodiment of the Tapeler assembly, which depicts the contours of both of the legs as well as the stapling head portion of the invention.

Referring to FIGS. 1 and 3, a tape dispenser cavity 12 is defined by the stapling leg 20, extending from the outer surface 20*a* toward the inner surface 20*b* thereof, in the preferred embodiment on a portion closer to the rear end 22 than the front end 21, in which a tape dispenser, comprising a tape dispensing spool 11 and a tape roll 8, is disposed. The cavity 12 is permanently exposed to an exterior of the stapling leg 20 through the outer surface 20*a* thereof so that the tape dispenser retained therein may be easily and quickly accessed when in need of dispensing or replacing the tape roll 8. The cavity 12, preferably rectangularly shaped, is bounded by two opposing side cavity surfaces 12*a* to which the tape dispensing spool 11 is rotatably and removably connected via a pivotal pin 11*a* as shown in FIG. 3. In the preferred embodiment, each of the side cavity surfaces 12*a* may have an upper marginal edge 12*b* which is convexly contoured in outward direction from the outer surface 20*a* as shown FIGS. 1 and 2. The spool 11 this aligned with a cutting member 7, so the tape 8 may be cut to size upon dispensing. FIGS. 1, 2, and 4 depict a raised circular boss 9, at the pivot connection 4 location, between the stapling leg 20 and the staple forming leg 30. This boss 9 is included in the preferred embodiment to provide a prominent surface on which graphical or advertising materials 13 may be imprinted. The use of this area for imprinting diminishes the prospects that the imprinting will fade or become worn off from repeated hand gripping, as would be the case of imprinting on a surface of one or both of the leg portions.

Figure 5:
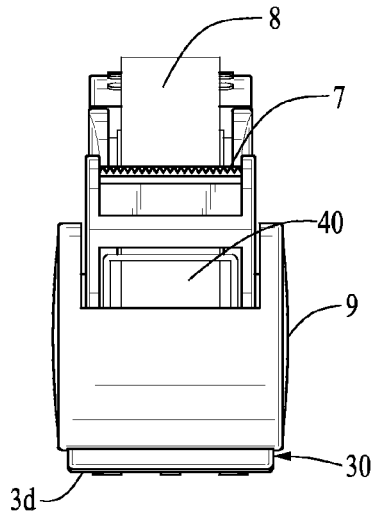
FIG. 5 is a view of the opposite end of a preferred embodiment of the Tapeler assembly, which depicts the tape dispensing mechanism.

FIG. 5 further depicts the clip opening 40, into which a belt clip or other attachment means would be inserted for ready attachment to another article.

Although the depicted preferred embodiment describes a device for use with staples and adhesive tape, the contemplated invention is not so limited. Embodiments are within the scope of this invention that use small brad nails, pins, tacks or any other fastening means which may be loaded into a stapling type device. Associated with these embodiments, the pivot connection 4 of the invention which maintains the preferred embodiment in a typical "stapling" position may be released in a conventional manner, so as to permit the stapling leg and staple forming leg to be aligned 180° with respect to one another, to permit driving fasteners into a surface without need of the forming plate.

Similarly, while the preferred embodiment depicts the combination device loaded with what appears to be ordinary adhesive tape 8, it may be utilized with any roll-shaped product, including but not limited to carpet tape, double sided tape, drywall tape, and fiberglass joint tape. As such, the contemplated device loaded, for example, with brad nails and drywall tape presents a heavy duty industrial Specification which is equally within the contemplated scope of the invention as that of a common staple/adhesive tape loaded combination device.

Finally, besides the raised boss 9, utilized for imprinted material, any of the generally flat surfaces of the combination device 10 is well suited for, and may be utilized for, the imprinting of graphical or advertising material 13 for the purposes of advertising or promotion as shown in FIGS. 1 and 2.

What is claimed is:

1. A combination device for stapling objects and retaining a tape dispenser, the combination device comprising:

a) a stapling leg and a staple forming leg, each of the legs having a front end and an opposing rear end, and an outer surface and an opposing inner surface, the inner surfaces facing each other, the legs being pivotally connected with each other, the stapling leg defining a tape dispenser cavity on a rear portion thereof closer to the rear end than the front end, the cavity being bounded by two opposing side cavity surfaces and extending from the outer surface of the stapling leg toward the inner surface thereof, the side cavity surfaces being configured to removably retain the tape dispenser within the cavity; and b) an ergonomic contoured first grip superimposed on a front portion of the outer surface of the stapling leg closer to the front end than the rear end, wherein the cavity is permanently exposed to an exterior of the stapling leg through the outer surface and inner surface thereof so as to provide quick access to the tape dispenser when retained therein.

2. The combination device of claim 1, further comprising a raised surface boss formed proximate the rear ends of the legs for disposing advertising material thereon.

3. The combination device of claim 1, further comprising staples.

4. The combination device of claim 3, wherein the stapling leg further comprises a staple storage formed on the inner surface thereof proximate the front end, in which the staples are stored.

5. The combination device of claim 1, further comprising an ergonomically contoured second grip superimposed on the outer surface of the staple forming leg.

6. The combination device of claim 1, wherein the grip has plurality of surface projections formed thereon for traction.

7. The combination device of claim 1, wherein each of the side cavity surfaces has a convexly-contoured upper marginal edge.

8. The combination device of claim 1, further comprising a tape dispensing spool removably and rotatably connected to the respective side cavity surfaces.

9. The combination device of claim 8, further comprising a roll-shaped attachment member wrapped around the tape dispensing spool, the attachment member being selected from the group consisting of ordinary scotch tape, carpet tape, double sided tape, drywall tape, and fiberglass joint tape.

10. The combination device of claim 9, further comprising a cutting member disposed at the rear end of the stapling leg.

11. The combination device of claim 9, wherein the stapling forming leg defines on the inner surface thereof a recessed section sized and configured to accommodate a bottom portion of the roll-shaped attachment member when the stapling leg is pressed against the stapling forming leg.

12. The combination device of claim 4, wherein the stapling leg further comprises an eject button formed on the outer surface thereof, the eject button being configured such that when pressed, the staple storage is projected so as to allow access to the staples therein.

13. The combination device of claim 1, further comprising fastening members selected from the group consisting of nails, pins, and tacks.

14. A combination device for stapling objects and retaining a tape dispenser, the combination device comprising:

(a) a stapling leg and a staple forming leg, each of the legs having a front end and an opposing rear end, and an outer surface and an opposing inner surface, the inner surfaces facing each other, the legs being pivotally connected with each other at the respective rear ends, the stapling leg defining a tape dispenser cavity on a rear portion thereof closer to the rear end than the front end, the cavity being bounded by two opposing side cavity surfaces and permanently exposed to an exterior of the stapling leg through both the outer and inner surfaces thereof, the side cavity surfaces being configured to removably retain the tape dispenser within the cavity;

b) an ergonomically contoured first grip superimposed on a front portion of the outer surface of the stapling leg closer to the front end than the rear end; and (c) an ergonomically contoured second grip superimposed on the outer surface of the staple forming leg.

15. The combination device of claim 14, wherein each of the grips has plurality of surface projections formed thereon for traction.

16. The combination device of claim 14, wherein each of the side cavity surfaces has a convexly-contoured upper marginal edge.

17. The combination device of claim 14, further comprising a tape dispensing spool removably and rotatably connected to the respective side cavity surfaces.

18. The combination device of claim 17, further comprising a roll-shaped attachment member wrapped around the tape dispensing spool, the attachment member being selected from the group consisting of ordinary scotch tape, carpet tape, double sided tape, drywall tape, and fiberglass joint tape.

19. The combination device of claim 18, further comprising a cutting member disposed at the rear end of the stapling leg.

20. The combination device of claim 18, wherein the stapling forming leg defines on the inner surface thereof a recessed section sized and configured to accommodate a bottom portion of the roll-shaped attachment member when the stapling leg is pressed against the stapling forming leg.

21. The combination device of claim 14, wherein further comprising staples.

22. The combination device of claim 21, further comprising a staple storage formed on the inner surface thereof proximate the front end, in which the staples are stored.

23. The combination device of claim 22, wherein the stapling leg further comprises an eject button formed on the outer surface thereof, the eject button being configured such that when pressed, the staple storage is projected so as to allow access to the staples therein.

24. The combination device of claim 14, further comprising fastening members selected from the group consisting of nails, pins, and tacks.

25. The combination device of claim 14, further comprising a raised surface boss formed proximate the rear ends of the legs and for disposing advertising material thereon.

26. A method of advertising comprising the steps of:

a) providing a combination device for stapling objects and retaining a tape dispenser, the combination device comprising:

(1) a stapling leg and a staple forming leg, each of the legs having a front end and an opposing rear end, and an outer surface and an opposing inner surface, the inner surfaces facing each other, the legs being pivotally connected with each other, the stapling leg defining a tape dispenser cavity on a rear portion thereof closer to the rear end than the front end, the cavity being bounded by two opposing side cavity surfaces and extending from the outer surface of the stapling leg toward the inner surface thereof, the side cavity surfaces being configured to removably retain the tape dispenser within the cavity, and 2) an ergonomically contoured grip superimposed on a front portion of the outer surface of the stapling leg closer to the front end than the rear end, wherein the cavity is permanently exposed to an exterior of the stapling leg through the outer surface and inner surface thereof so as to provide quick access to the tape dispenser when retained therein; and b) disposing advertising material on at least one external surface of the combination device.

* * * * *